United States Patent [19]

Werner

[11] Patent Number: 4,787,672

[45] Date of Patent: Nov. 29, 1988

[54] SEATING FURNITURE, MORE PARTICULARLY CHAIR

[75] Inventor: Hans-Hugo Werner, Stuttgart, Fed. Rep. of Germany

[73] Assignee: VS Vereinigte Spezialmoebelfabriken Verwaltungs GmbH, Fed. Rep. of Germany

[21] Appl. No.: 48,760

[22] Filed: May 12, 1987

[30] Foreign Application Priority Data

May 23, 1986 [DE] Fed. Rep. of Germany ..... 3617298

[51] Int. Cl.[4] ..... A47C 3/00

[52] U.S. Cl. ..... 297/296; 297/445; 297/287; 297/299

[58] Field of Search ..... 297/299, 295, 256, 287, 297/445

[56] References Cited

U.S. PATENT DOCUMENTS 1,377,600 5/1921 Prest ..... 297/294
2,679,282 5/1954 Anderegg ..... 297/445 X
3,357,741 12/1967 Vadner ..... 297/445
4,618,185 10/1986 Kaufman ..... 297/287 X

FOREIGN PATENT DOCUMENTS 805612 11/1936 France ..... 297/295
317533 5/1934 Italy ..... 297/294

*Primary Examiner*—Peter A. Aschenbrenner
*Attorney, Agent, or Firm*—Steele, Gould & Fried

[57] ABSTRACT

An article of seating furniture (1) is constructed as a free oscillator having side members (6) with substantially Z-shaped resilient supporting sections (7), the supporting sections having a top end portion (9), a bottom end portion (8), and an intermediate portion (10) between them. The end portions (8), (9) of the supporting sections (7) are interconnected via a rod-shaped resiliently deformable reinforcing member (12) inclined oppositely to the intermediate portion (10) of the supporting sections. This construction prevents the chair from oscillating or seesawing excessively.

32 Claims, 4 Drawing Sheets

SEATING FURNITURE, MORE PARTICULARLY CHAIR

BACKGROUND OF THE INVENTION

1. Field of the Invention

The invention relates to an article of furniture, more particularly a chair, having at least one support profile which is disposed laterally of a seat member, forms in side elevation differently directed supporting portions and has between a top end portion and a bottom end portion an intermediate portion differing from the vertical position and adjoining pivotably and resiliently at least one of said end portions.

2. Prior Art

Such articles of seating furniture, which can also be low or ordinary chairs and settees for two or more people, are usually called "free oscillators", in which due to the resilient lower frame of the seat, as a rule formed by two lateral supporting sections, the seat member can perform under load vertically resilient movements, usually over a relatively large portion of an arc of a circle. The supporting sections, which are usually metal tube sections, must be very heavily dimensioned, in order to prevent rupture due to material fatigue and to produce a relatively steeply rising spring characteristic. Nevertheless, such seats readily seesaw or oscillate, and this is undesirable, especially when they are used disposed in rows.

SUMMARY OF THE INVENTION

It is an object of the invention so to construct an article of seating furniture of the kind specified as to achieve the advantages of the free-oscillator types of seats and at the same time prevent excessive oscillation.

To this end, in an article of seating furniture of the kind specified, according to the invention the two end portions of the support profiles are interconnected via a stretched (tensile stressed) reinforced member which has in side elevation a position differing from the position of registration with the intermediate portion. This means that inside or outside at least one end of the reinforcing member, the supporting section is attached at a smaller or larger distance from such end to the reinforcing member, which can extend over substantially the total height of the supporting section and damps at least the intermediate portion as regards its resilient pivoting movement, in dependence on the position of the reinforcing member and the arrangement of its connecting places, so that the spring characteristic of the supporting section can be influenced substantially as required.

A particularly effective result is achieved by the feature that in side elevation the reinforcing member crosses the intermediate section or its central axis more particularly in X-shape substantially at the height of the seat member, so that therefore at least a lower portion of the reinforcing member forms together that portion of the supporting section which lies at the same height a triangle which is, for example, substantially isosceles in side view and whose apex conveniently lies substantially at the level of the bottom side of the seat member—i.e., slightly below the sitting level. From the top attaching place the reinforcing member can be so downwardly directed at an angle that it lies completely within the arc of a curve or circle through which such attaching place passes during resilient movement, the angle of inclination of the reinforcing member being between about 40° and 70°.

If the resilient reinforcing member is required to have a relatively soft spring characteristic without such member having to be made from hardened spring steel, conveniently at at least one end portion of the reinforcing member is attached immediately adjacent its free end so that the, for example, structural steel, plastic or like reinforcing member can have a maximum length when it is attached in this manner to both end portions.

It is conceivable that the top end/or bottom end of the reinforcing member could be pivotably connected to the supporting section, for example, around a substantially horizontal axis lying in the direction of the seat width, but the simplified construction achieves an enhanced springing effect if the reinforcing member is rigidly attached to the top and/or bottom end portion. The rigid attachment can be performed by screws, rivets, gluing and, with suitable materials, by welding or the like. In any case a very simple attachment is made possible by the feature that the reinforcing member is attached by an end pin which lies at an angle thereto, engages, for example, in an aperture immediately in the wall of the end portion, and is advantageously constructed in one piece with the reinforcing member, more particularly by the end being bent.

More particularly, to the extent that the reinforcing member secures the supporting section in a resiliently prestressed position under tensile loading and thereby gives the chair frame a spring characteristic which starts above zero, it is conceivable for the reinforcing member to be formed by a pure, for example, slack-bending pulling member, such as a cable. However, in a very advantageous embodiment the reinforcing member secures the supporting section in the substantially relieved condition when the chair or the like is unloaded and is constructed in the form of a rod which is mainly subjected to compressive loading.

The reinforcing member can be formed by a section or rod of any required cross-section, but it can also have cross-sectional widenings and cross-sectional taperings preferably continuously over its length. In a very simple embodiment the reinforcing member has circular cross-sections and/or a smooth surface, so as to offer as low a resistance as possible when contacted.

It is also conceivable to subject the reinforcing member to a slight compressive prestressing in the initial position—i.e., with the chair or the like unloaded—or to construct the reinforcing member curved and slightly deviating from a rectilinear course, so that under compressive loading it is only slightly further curved in this given direction of curvature. In any case—i.e., even with a construction stretched in a straight line in the initial condition—the arrangement is conveniently such that underloading the reinforcing member is deformed only in one single plane which conveniently lies parallel with the plane of the supporting section or stands substantially vertical.

According to a further feature of the invention the top and/or bottom end portion of the more particularly Z-shaped supporting section lies substantially parallel with the standing plane of the chair or the like, so that the bottom end portion can act directly as a standing arm forming the standing surface of the chair or the like, while the top end portion can form a chair armrest. The top end of the reinforcing member can more particularly in this case be provided substantially vertically above the pivoting axis, which lies substantially at the level of the standing plane and which is determined by the transition from the intermediate portion into the bottom end portion. In another embodiment the top end portion is inclined upwards, more particularly at an inclination backwards such that together with the intermediate portion it encloses a rearwardly opening angle of about 90° or more. In that case the top end of the reinforcing member can either be attached to the supporting section in the transitional zone between such end portion and the intermediate portion, or it can lie, viewed in side elevation, substantially in registration with such end portion and be attached thereto between such transition and its end remote from the intermediate portion.

The top end of the reinforcing member therefore advantageously lies above the seat member, and in side elevation it can terminate in the zone of the associated side edge of the chair back, so that the top end portion of the reinforcing member, lying above the seat member, crosses after the fashion of a side cheek the angle between the seat member and the chair back and forms an additional lateral boundary for the person seated.

The reinforcing member can in a very simple manner be disposed immediately adjacent the outside of the associated supporting section and secured in relation thereto exclusively in the zone of its ends. However, the reinforcing member can also pass through the supporting section, more particulrly the intermediate portion, in the zone of an aperture, so that the reinforcing member is additionally guided between its ends, or the reinforcing member can be disposed on the inside of the supporting section between the latter and the seat member, so that, for example, a cross-member interconnecting two lateral supporting sections and lying immediately below the seat member can be used to guide and act as a stop limiting the reinforcing member, which is secured between the supporting section and the seat member against bulging out sideways. However, the guide can also be formed by a separate guide head of plastics or the like which is attached to the supporting section and has, for example, positive-connection members for a plug-in or similar connection to the adjoining chairs in a row.

The reinforcing member can have very thin cross-sections in relation to the cross-sections of the rest of the chair frame, for example, a diameter of about 8 mm, and it can also have either solid cross-sections or else holow cross-sections, for example, after the fashion of a tube. In contrast, the supporting section conveniently has flat cross-sections which can be rectangular, over all the like and whose major cross-sectional dimension lies in the width direction of the chair or the like. The reinforcing member enables the cross-sections of the supporting sections to be if required weaker than in the case of the chair or the like without any such reinforcing member.

These and other features of preferred further embodiments of the invention can also be gathered from the description and drawings.

BRIEF DESCRIPTION OF THE DRAWINGS

The individual features can be put into effect individually or jointly in the form of subcombinations in an embodiment of the invention and in other fields. Embodiments of the invention will be described in greater detail hereinafter with reference to the drawings, wherein.

DETAILED DESCRIPTION OF THE PREFERRED EMBODIMENTS

Figure 1:
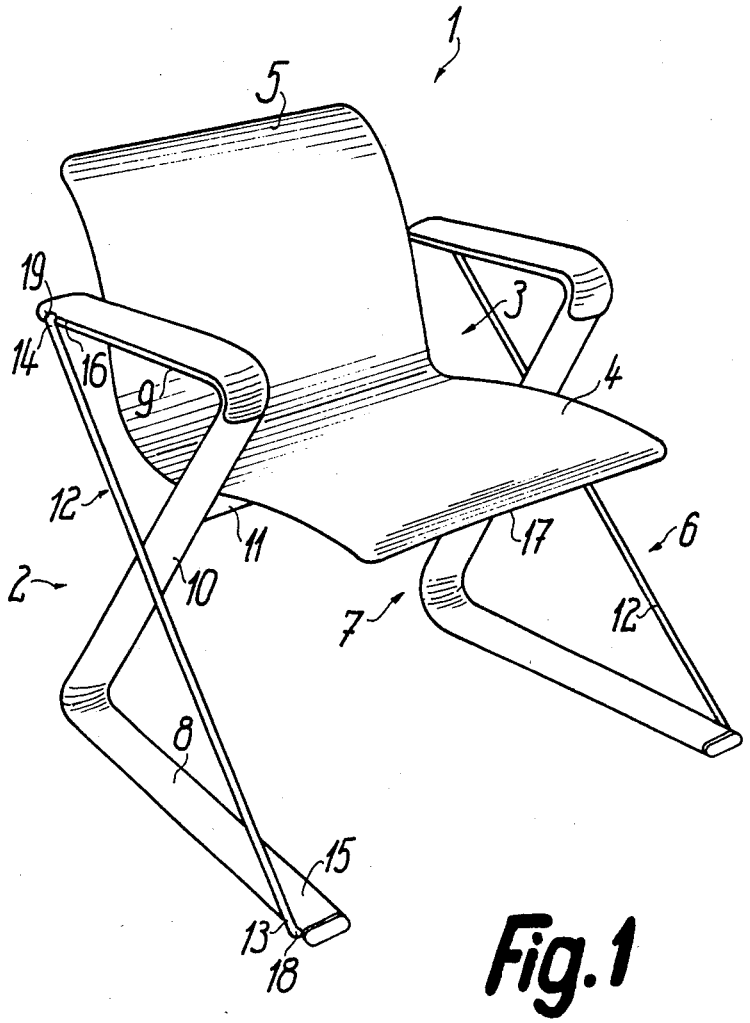
FIG. 1 is a perspective view of a chair or the like according to the invention
Figure 2:
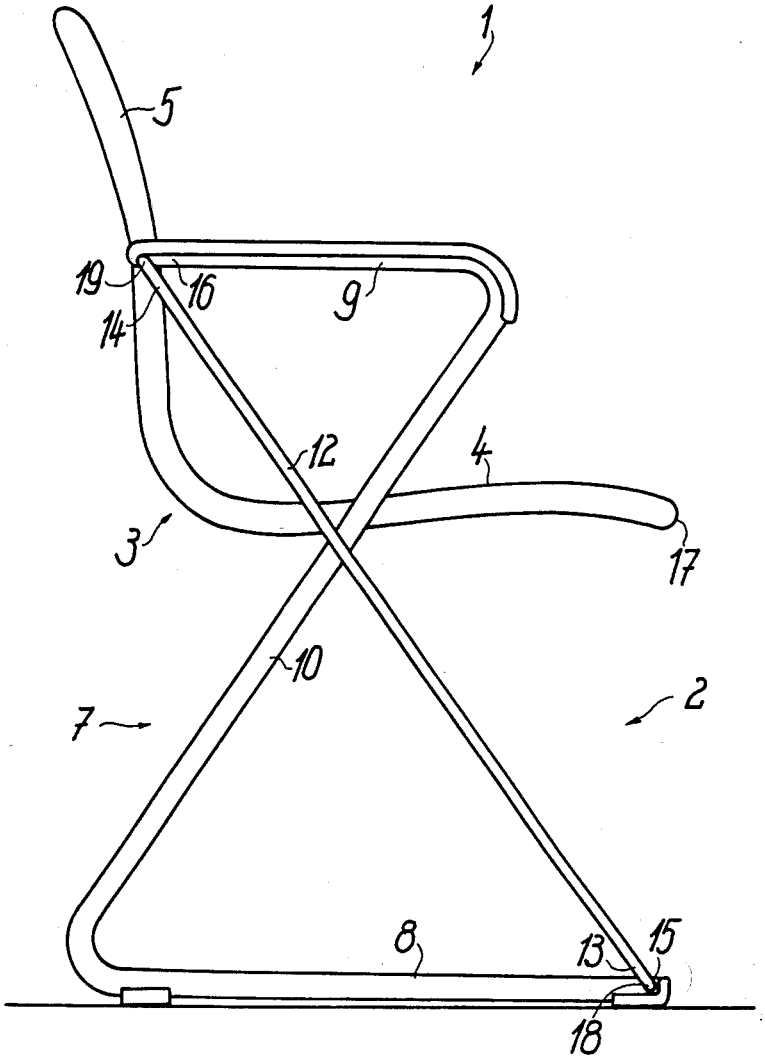
FIG. 2 is a side elevation from the left of the chair or the like shown in FIG. 1.
Figure 3:
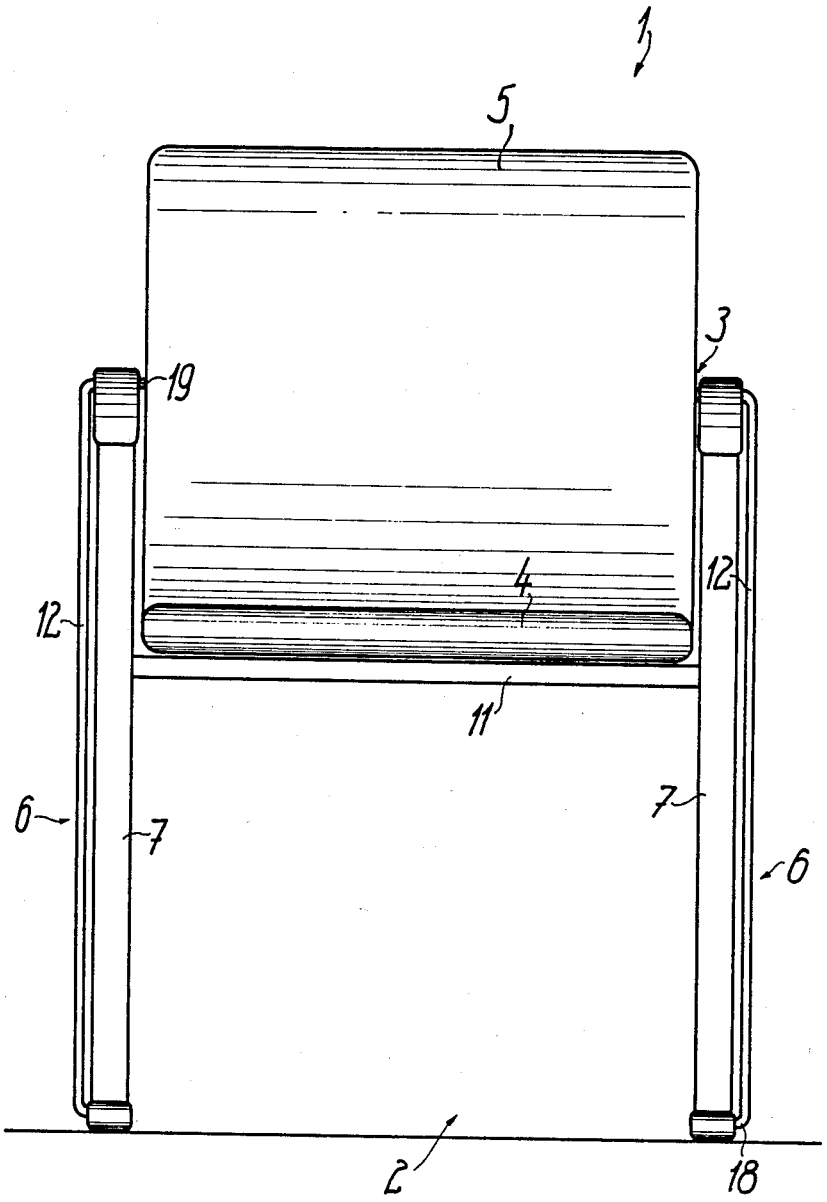
FIG. 3 is a front elevation of the chair or the like shown in FIGS. 1 and 2.

As shown in FIGS. 1 to 3, an article of seating furniture 1 according to the invention has a chair frame 2 which is at least partially made of metal, more particularly steel wood and/or at least partially of plastics, timber, more particularly plywood, or the like and which bears a seat body 3. The seat body 3, which is conveniently formed from a plate, has a substantially constant thickness and is substantially angular in side view, forms with its lower portion a seat member 4 and with its rear, upwardly extending portion a chair back 5.

The chair frame 2 is formed mainly by two side members 6 which are disposed laterally of the seat body 3 and immediately adjacent thereof and which each have a substantially Z-shaped bent supporting section 7.

Each of the two identically constructed supporting sections 7 forms a bottom end portion 8 which lies substantially horizontal and parallel with the standing surface of the chair 1 or the like, a parallel end portion 9, which is however oppositely directed backwards, and an intermediate portion 10 which interconnects the end portions 8, 9, is inclined forwardly from the rear end of the end portion 8 and in the embodiment illustrated passes directly via part-circular bent portions into the end portions 8, 9, although it is also conceivable for a further portion to be provided between the intermediate portion 10 and at least one end portion which occupies a different angular position in relation to these two portions. A cross-member 11 interconnects the two side members 6 by the cross-member 11 being rigidly attached by welding or the like to the facing insides of the supporting sections 7, namely the intermediate portions 10. In the zone of the rear half of the seat member 4 the cross-member 11 lies immediately below the seat member 4, so that the seat body 3 can be supported by being borne on the cross-member 11 and the seat member 4 projects freely forwards and therefore if necessary slightly resiliently from the cross-member 11; the seat body 3 can be formed by a shaped member of wood, plastics or the like. In the zone of the chair back 5 the seat body 3 can also be fixed in relation to the side members 6 and the supporting sections 7, preferably at substantially half the height of the chair back 5, such chair back 5 being conveniently attached in the zone of the rear ends of the top end portions 9, and such rear ends extending in side elevation at most as far as ther ear side of the chair back 5.

Each side member 6 has at least one rod-shaped, preferably continuously one-part reinforcing member 12 which can be resiliently loaded in its longitudinal direction and which, when the chair or the like 1 is unloaded, is stretched at least substantially rectilinearly and, viewed in side elevation (FIG. 2), collaborates with the supporting section 7 to enclose two substantially isosceles triangles whose apices are directed towards one another, the top triangle being smaller than the bottom triangle. The reinforcing member 12 is attached via its ends 13, 14 substantially rigidly to the associated supporting section 7, the bottom end 13, viewed in side elevation (FIG. 2), being disposed in the zone of the front end 15 of the bottom end portion 8, immediately adjacent its end surface, and the top end 14 being disposed in the zone of the rear end 16 of the top end portion 9, also immediately adjacent its end surface. As a result, the bottom end 13 of the reinforcing member 12, viewed in side elevation (FIG. 2), lies substantially vertically below the front edge 17 of the seat member 4 and only slightly offset rearwardly in relation thereto. The top end 14 of the reinforcing member 12 lies in the zone of the rear side of the chair 1 or the like, viewed in side elevation (FIG. 2), between the front side and the rear side of the chair back 5, substantially at half its height. Viewed in side elevation, the reinforcing member 12 crosses the intermediate portion 10 at an angle differing from 90° and at a height lying in the zone of the cross-member 11—i.e., immediately below the seat member 4. As a result, that portion of the reinforcing member 12 which lies above the crossing palce bounds together with the seat body 3 a substantially rectangular or isosceles triangle, the crossing place lying in the rear half as far as the rear third of the seat member 4. Viewed in side elevation (FIG. 2), the front end of the top end portion 9 lies in a vertical plane lying substantially in the middle between the crossing place and the bottom end 13 of the reinforcing member 12.

Each of the reinforcing members 12, identical in construction and, viewed in side elevation (FIG. 2), like the supporting sections 7 lying in registration with one another, has at the top and bottom end a short end pin 18, 19 which lies substantially perpendicular to reinforcing members 12, is directed against the associated supporting section 7 and can be formed in a very simple manner by a suitable bending of the reinforcing member 12. Provided in the associated side surface of the supporting section 7 for each end pin 18, 19 is a bore closely adapted thereto, into which the associated end pin 18, 19 is inserted and which is so secured, for example, by welding from the inside, that the reinforcing member 12, viewed in front elevation (FIG. 3), lies between its end pins 18, 19 at a small constant clearance with the associated supporting sections 7 adjacent thereto but not in contact. The top end pin 19 can be long enough that it passes through the top end portion 9 of the supporting section 7—i.e., projects beyond its inner side and acts as a device for securing the position of the chair back 5; the top end pin 19 can engage behind the chair back 5 or engage in a corresponding aperture in the side edge of the chair back 5, so that no additional attaching means are required for the attachment of the chair back 5.

Conveniently each supporting section 7 has sectional cross-sections which are at least substantially flatly rectangular or flatly oval and whose major cross-sectional extension lies in the width direction of the chair 1 or the like—i.e., horizontally—the major cross-sectional extent being conveniently about twice as large as the minor cross-sectional extent lying at right angles thereto. The average radii of curvature of the part-spherical curved transitional portions between the intermediate portion 10 and the end portions 8, 9 can be relatively small end lie between the two aforementioned cross-sectional dimensions of the supporting sections. In contrast, the maximum cross-sectional dimension of the reinforcing member 12 can be substantially smaller namely, for example, only about one sixth of the maximum cross-sectional dimension of the supporting sections 7. Viewed in side elevation (FIG. 2), the bottom end portion 8 of the supporting sections 7 can be slightly upwardly arched between its ends, thus ensuring that it stands on the floor only in the zone of such ends. In the embodiment illustrated, disposed at the front and rear end of each bottom end portion 8 are standing blocks in the form of sectional blocks of plastics or the like, of which the front one covers the front end surface of the end portion 8. The top end portion 9 can also have on the top side a cushion-like covering which extends continuously substantially over its length, conveniently covers the rear end surface of the top end portion 9 and can extend beyond the curved transitional zone between the front end of the end portion 9 and the intermediate portion 10, thus forming a cushioned armrest.

Figure 4:
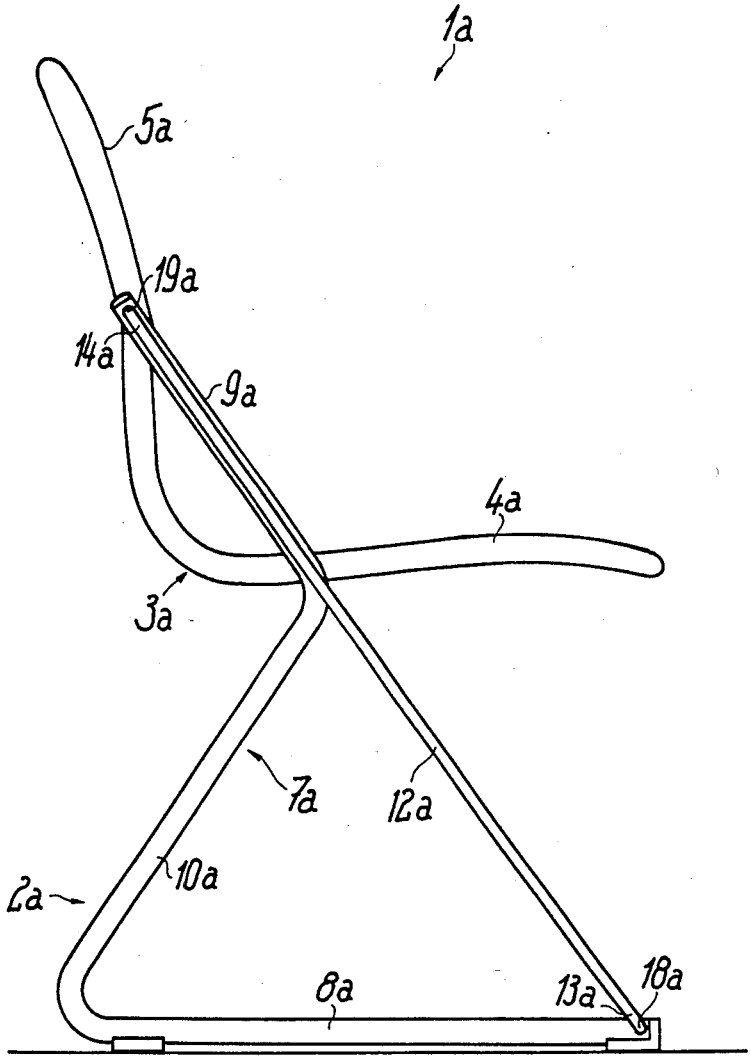
FIG. 4 illustrates a further embodiment of a chair or the like, shown in a manner corresponding to FIG. 2.

In FIG. 4 like elements to those in FIGS. 1–3 have like references with the addition of the index "a". While the chair shown in FIGS. 1 to 3 is constructed in the form of an armchair, the chair 1*a* (FIG. 4) is constructed as a chair without armrests but having a back rest. The top end portion 9*a* of each supporting section 7*a* of the chair frame 2*a* occupies a position which deviates from the position parallel with the end portion 8*a* and from the horizontal position, and is more particularly parallel with the reinforcing member 12*a*, the top end portion 9*a* being so inclined upwards and rearwardly that the top end part of the reinforcing member 12*a*, viewed in side elevation (FIG. 4), lies in registration with such end portion 9*a* and extends substantially over its whole length. The reinforcing member 12*a* therefore does not cross the supporting section 7*a* or the intermediate portion 10*a*, but from the transitional portion between the end portion 9*a* and the intermediate portion 10*a* lies immediately adjacent and alongside the end portion 9*a*. The top end pin 19*a*, which might also be provided in the zone of this transitional portion, lies as in the case of the embodiment illustrated in FIGS. 1 to 3 above the seat part 4*a* in the zone of the chair back 5*a*. Since the cross-sectional extent of the reinforcing member 12*a* is smaller than the minor cross-sectional extent of the supporting section 7*a*, the top end port of the reinforcing member 12*a* viewed in side elevation (FIG. 4), can lie between the planes of the front side and rear side of the end portion 9*a*, although it is also conceivable for this end part to lie within the end portion 9*a*.

The part of the seat member lying in front of the cross-member 11 can also be resiliently supported by one or more resilient strips (not shown) which are disposed on besides the other and other project freely forwards and are supported at least via their front ends on the underside of the seat member 4. The resilient strips are conveniently attached to the cross-member, which in this case can be formed by a slotted tube, in which the resilient strips so engage via attaching heads produced at their rear ends by bending that they extent adjacent to their attachning heads, secured against twisting, through the slot, which extends over the length of the tube and is adapted to their thickness. Between adjacent resilient strips and adjacent thereto, tube portions can be placed on the outer periphery of the slotted cross-member which are adapted closely to such outer periphery and form on the one hand spacing members for the resilient strips and on the other securing clamps for the slotted tube, that in spite of the continuous longitudinal slot the tube cannot be accidentally bent upwards. In this case the seat body 3 is conveniently mounted to pivot or swing around a horizontal transverse axis lying, for example, below the seat member 4 in the zone of the topside of the cross-member 11 and is secured by the resilient strips against excessive tilting movements forwards and/or backwards. This embodiment is essential to the invention is also conceivable for other articles of seating furniture other than those described—i.e., more particularly also for such articles as have no reinforcing members. The aforementioned transverse axis can also coincide with the central axis of the cross-member 11 formed, for example, by a cylindrical tube, so that the cross-member 11 forms a pivot bearing for the seat body 3 by the cross-member 11 being engaged around, at least over a portion of its periphery, by clamp-like bearing shells attached to the underside of the seat member 4. The particular end 13, 14 and the particular end pin 18, 19 can also engage in a separate end member of plastics, steel or the like which is attached to the free end of the associated end portion 8, 9, for example, by the separate end member having a shaft portion, which can be inserted positively in the associated end portion 8, 9, and a heat portion, projecting beyond the end surface, for the engagement of the particular end pin 18, 19.

I claim:

1. An article of furniture for seating, having a front, back and two lateral sides, the article comprising:

a seat member (4);

at least one elastic lateral support (7) made of an elongated profile material and disposed laterally of said seat member (4);

said lateral support (7) defining a plurality of supporting sections located in different orientations as viewed from the sides, and having profile cross-sections;

an intermediate section (10) of said supporting sections being provided between an upper end section (9) and a lower end section (8) of said lateral support (7), said intermediate section (10) having a non-vertical orientation and adjoining at least one of said end sections (8) pivotably, resiliently and at an angle with respect to said at least one of said end sections (8), wherein the end sections (8,9) of the lateral support (7) are interconnected via a substantially elongated reinforcing member (12) having, when viewed from said sides, an orientation out of registration with the intermediate section (10), said reinforcing member (12) being a compression rod and a tension rod and having a cross-section smaller than the profile cross-section of said lateral support (7).

2. An article of furniture according to claim 1, wherein as viewed from said sides, the reinforcing member (12) crosses the intermediate section (10) substantially defining with the intermediate portion an X-shape.

3. An article of furniture according to claim 1, wherein said seat member (4) defines a height location and as viewed from said sides, the reinforcing member (12) crossing the intermediate section (10) substantially at said height location.

4. An article of furniture according to claim 1, wherein the reinforcing member (12) is located directly adjacent but out of contact with an outside of the intermediate section (10), said outside of the intermediate section (10) being a side of the intermediate section remote from the seat member.

5. An article of furniture according to claim 1, wherein at least one of the end sections (8,9) has a free end, the reinforcing member (12) being attached to said at least one of the end sections (8,9) immediately adjacent the free end (15,16) thereof.

6. An article of furniture according to claim 1, wherein the reinforcing member (12) is attached to a said at least one of the end sections (8,9) rigidly.

7. An article of furniture according to claim 1, wherein the reinforcing member (12) is attached to the at least one end of section (8,9) via a pin-like end member (18, 19) provided at an angle relative to the reinforcing member (12).

8. An article of furniture according to claim 1, wherein said end member (18,19) engages in an aperture in the end section (8,9).

9. An article of furniture according to claim 1, wherein the reinforcing member (12) has end members, the reinforcing member being substantially continuously retilinear between said end members.

10. An article of furniture according to claim 1, wherein the reinforcing member (12) has substantially continuously identical cross-sections all along a length extension defined by the reinforcing member (12).

11. An article of furniture according to claim 1, wherein as viewed from said sides, the reinforcing member (12) is inclined.

12. An article of furniture according to claim 11, wherein said lateral support (7) defines a standing plane for the article of furniture, said reinforcing member (12) and said intermediate portion (10) being inclined by substantially equal angles with respect to said standing plane.

13. An article of furniture according to claim 12, wherein at least one of said angles is substantially 55°.

14. An article of furniture according to claim 1, wherein at least one of the top and bottom end sections (8,9) of the substantially Z-shaped lateral support (7) is located substantially parallel to a standing plane of the article of furniture (1).

15. An article of furniture according to claim 1, wherein said article defines a back side projecting from the intermediate section (10) toward said back side, said top end section (9) being shorter than the bottom end section (8).

16. An article of furniture according to claim 1, wherein said article defines a front side 2 the bottom end section (8) projecting from said intermediate section towards said front side, said bottom end section being slightly curved upwards.

17. An article of furniture according to claim 1, wherein the top end section **(9*a*)** is upwardly directed at substantially an incline.

18. An article of furniture according to claim 17, wherein when viewed from the sides a top end portion of the reinforcing member **(12*a*) is located substantially in registration with the top end section (9*a*) of the reinforcing member (12*a*)**.

19. An article of furniture according to claim 1, wherein a top end member (14) of the reinforcing member (12) lies above the seat member (4).

20. An article of furniture according to claim 1, further comprising a seat back (5) having side edges, the top end members (14) of the reinforcing member (12) as viewed from side sides being located in the vicinity of an associated one of the side edges of the seat back (5).

21. An article of furniture according to claim 20, wherein said seat back defines a front side and a rear side and, when viewed in elevation from the sides, the top end member (14) of the reinforcing member (12) is located between said front and rear side of the seat back (5).

22. An article of furniture according to claim 1, wherein said seat member defines a front edge, and when viewed from said sides, a bottom end member (13) of the reinforcing member (12) is located substantially vertically below said front edge (17) of the seat member (4).

23. An article of furniture according to claim 1, further comprising means securing a location of said reinforcing member (12) between its top and bottom end members (13,14) with respect to the lateral support (7).

24. An article of furniture according to claim 23, wherein said means for securing the location of the reinforcing member (12) displaceably guide the reinforcing member (12) with a moving play.

25. An article of furniture according to claim 23, wherein a guide is disposed on the lateral support (7), the reinforcing member (12) extending with clearance through said guide, thereby permitting a motion clearance for the reinforcing member (12).

26. An article of furniture according to claim 1, wherein the profile cross-section of the lateral support (7) defines a flattened shape.

27. An article of furniture according to claim 1, wherein the article defines a width for sitting, extending across the seat member (4) in a width direction, the lateral support (7) having a maximum cross-sectional extension in the width direction of the article (1).

28. An article of furniture according to claim 1, wherein the reinforcing member (12) has a cross-section several times smaller than the profile cross-section of the lateral support (7).

29. An article of furniture according to claim 1, wherein the article is a chair.

30. An article of furniture according to claim 6, wherein the reinforcing member (12) is attached to the at least one of the end sections (8,9) by welding.

31. The article of furniture according to claim 26, wherein the profile cross-section of the lateral support (7) is substantially rectangular.

32. The article of furniture according to claim 26, wherein the profile cross-section of the lateral support (7) is substantially oval

* * * * *

UNITED STATES PATENT AND TRADEMARK OFFICE

CERTIFICATE OF CORRECTION

PATENT NO. : 4,787,672

DATED : November 29, 1988

INVENTOR(S) : Hans-Hugo Werner

It is certified that error appears in the above-identified patent and that said Letters Patent is hereby corrected as shown below:

Column 3, line 28 delete "particulrly" and insert --particularly--.

Column 3, line 48 delete "holow" and insert --hollow--.

Column 4, line 15 delete "wood" and insert --tubing--.

Column 4, line 16 delete "timber" and insert --wood--.

Column 4, line 57 delete "ther ear" and insert --the rear--.

Column 5, line 21 delete "palce" and insert --place--.

Column 6, line 43 delete "port" and insert --part--.

Column 8, line 65 delete "side" and insert --said--.

Signed and Sealed this

Seventeenth Day of October, 1989

*Attest:*

DONALD J. QUIGG

*Attesting Officer*

*Commissioner of Patents and Trademarks*